United States Patent [19]

Noetzelmann, Sr.

[11] 4,433,208

[45] Feb. 21, 1984

[54] PRESSURIZABLE TELEPHONE LOAD COIL ASSEMBLY

[75] Inventor: David C. Noetzelmann, Sr., Minatare, Nebr.

[73] Assignee: Midwec Toroid & Capacitor Corporation, Rolling Meadows, Ill.

[21] Appl. No.: 296,678

[22] Filed: Aug. 27, 1981

[51] Int. Cl.[3] ..... H01F 17/08; H01F 27/04; H01F 15/02

[52] U.S. Cl. ..... 178/46; 336/90

[58] Field of Search ..... 178/45, 46; 336/65, 336/90

[56] References Cited

U.S. PATENT DOCUMENTS 4,172,964 10/1979 Reinebach ..... 178/46

4,260,853 4/1981 Charles ..... 178/46

*Primary Examiner*—Stafford D. Schreyer

*Assistant Examiner*—M. Bumbery

*Attorney, Agent, or Firm*—Leydig, Voit, Osann, Mayer & Holt, Ltd.

[57] ABSTRACT

A pressurizable telephone load coil assembly is made by placing groups of load coils in enclosure packages, connecting conductors of a length of telephone cable to the load coils, binding the enclosure packages together, placing the bound enclosure packages in a closed end heat-shrinkable tube, encapsulating the enclosure packages, and heat shrinking the open end of the tube over hot-melt glue applied to the end of the length of telephone cable. A heat shrinkable cap including an air valve is shrunk over the opposite end the length of telephone cable to pressurize the load coil assembly to exclude moisture until the telephone cable is spliced into a pressurized telephone system.

13 Claims, 5 Drawing Figures

PRESSURIZABLE TELEPHONE LOAD COIL ASSEMBLY

BACKGROUND OF THE INVENTION

This invention relates to a compact, pressurizable load coil assembly.

Loading coils find extensive use in the telephone industry. Wire pairs extending between a central office and a subscriber's telephone have substantial capacitance, resulting in a change in impedance with length. It is desirable to maintain a predetermined impedance, to assure maximum signal power transfer between the central office and the subscriber's telephone. To accomplish this, inductive load coils are connected to the wire pairs at intervals, such as at pedestal cabinets, and the like are spaced a predetermined distance apart, so that the known capacitance of the resulting predetermined length of wire pairs will be balanced by the inductance of a standard load coil.

Numerous structures for load coil assemblies are known. Basically, load coils are assembled in some compact configuration, such as is shown in U.S. Pat. No. 4,172,964, issued to Reinebach on Oct. 30, 1979, and encapsulated, in an attempt to keep moisture from affecting the load coil assembly, such as by oxidizing the metal of the inductor cores, commonly toroidal cores due to the low losses obtainable with this configuration, or damaging the insulation of the wires in the load coil assembly, or forming conductive paths between wire pairs in the load coil assembly, resulting in degraded compensation and increased cross linking and cross talk between wire pairs. However, with the passage of time, encapsulating compound absorbs moisture, which eventually deteriorates the load coil assembly.

Conventionally, telephone cables may be pressurized, and may be spliced together in an airtight manner, such as by being covered with a heat-shrinkable tubing after splicing, However, where load coils are to be connected, the end of the cable is sealed off, such as by an encapsulating compound or heat-shrinkable sleeve, and the individual wire pairs of the cable are connected to individual wires extending from the load coil assembly.

SUMMARY OF THE INVENTION

The present invention is a pressurizable load coil and telephone cable assembly which is simple to make and dependable in use, a mechanically strong and pressure-tight seal being made between the telephone cable and the load coil case, and pressurization of the telephone cable serving to prevent moisture from entering the load coil assembly. The load coil assembly may be encapsulated in conventional manner, the pressurization of the telphone cable preventing the absorption of atmospheric moisture by the encapsulating material during storage or in use.

The present invention contemplates a load coil assembly including two or more enclosure packages, each enclosure package holding several loading coils, connected to the ends of pairs of wires of a telephone cable, the enclosure packages being bound together and inserted into a closed-end heat shrinkable case. The case is then preferably filled with encapsulating compound, to the end of the telephone cable. A section adjacent the end of the telephone cable is coated with a hot-melt adhesive, and the open end of the case is shrunk down upon the hot-melt adhesive. The free end of the telephone cable is fitted with a pressurization valve, and pressure is applied to the cable assembly to verify the integrity of the cable and seal, and to prevent moisture from entering the cable, case or encapsulating material until such time as the loading coil assembly is connected to a pressurized telephone cable system.

Accordingly, it is an object of the invention to provide a pressurizable load coil assembly. It is a feature of the invention that the case of the load coil assembly is a heat shrinkable closed-end tube, shrunk by heating to form a seal between the load coil case and a section of telephone cable. It is a feature of the invention that pressure within the telephone cable prevents the entry of moisture into the load coil assembly. It is a further feature of the invention that a mechanically strong junction is formed between the load coil case and the section of telephone cable.

DESCRIPTION OF THE PREFERRED EMBODIMENTS

Figure 1:
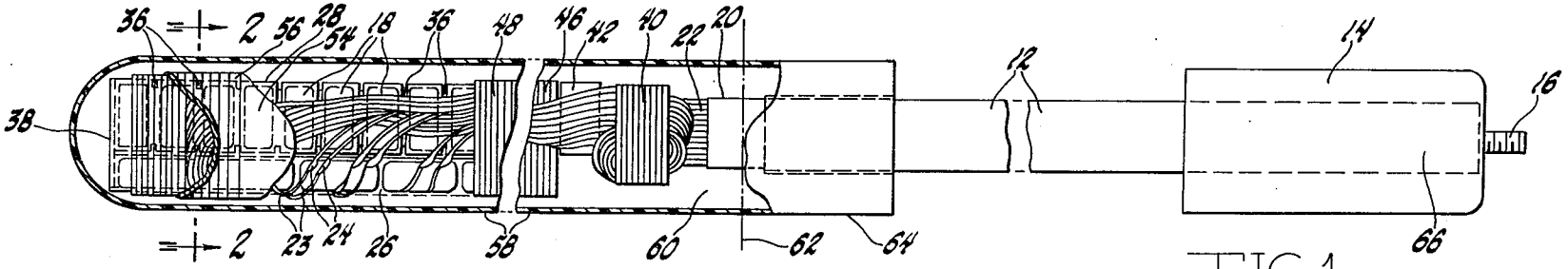
FIG. 1 is a side elevational view, partially in section, showing a load coil assembly according to the invention prior to the application of heat to the load coil case and air valve cap.
Figure 2:
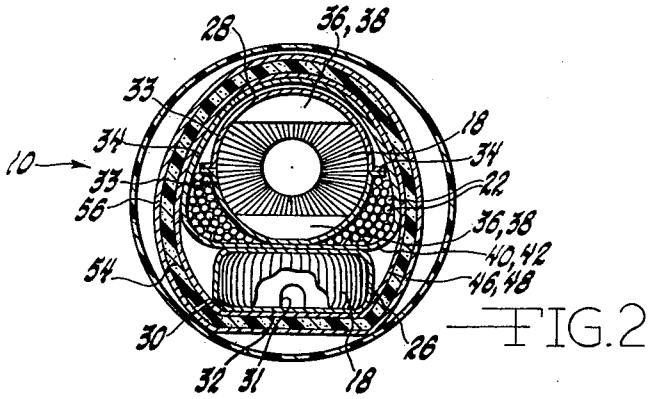
FIG. 2 is a sectional view taken along line 2—2 in FIG. 1.
Figure 3:
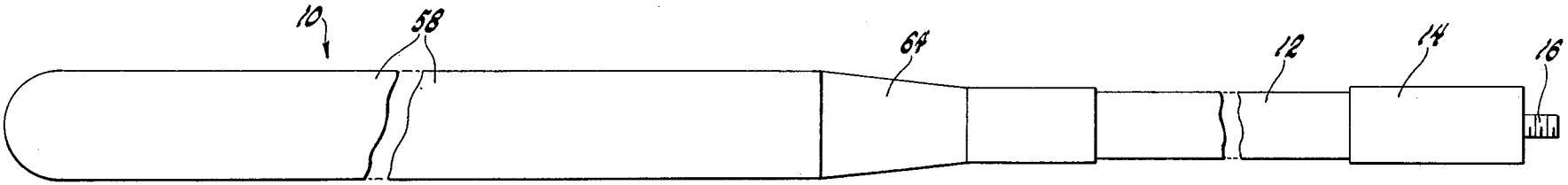
FIG. 3 is a side elevational view, after application of heat to the load coil case and air valve cap.

Referring to FIGS. 1, 2 and 3, there is shown a first embodiment of a load coil assembly including a load coil package 10, a length of multiple conductor pressurizable telephone cable 12, and a heat shrinkable pressurization cap 14 having a conventional pressure valve 16, of the type conventionally used for pressurizing such things as automobile tires.

Load coil package 10 includes a plurality of conventional bifilar-wound torodial core load coils 18. As is conventional, the two coils formed by the bifilar winding are connected in series with the wires known as tip and ring leads, respectively, of the paired conductors of multiple conductor pressurizable telephone cable 12. The insulation is removed from cable 12 adjacent end 20, leaving paired conductors 22 exposed. For ease in connection, the paired conductors 22 are connected to the bifilar-wound torodial core load coils 18 before any further assembly of load coil package 10. Each connector of paired conductors 22 is connected to an end 23 of a winding of bifilar-wound torodial core load coil 18 in a predetermined sequence, and each connection is insulated by dipping it in an insulating compound, preferably an air-curing plastic resin, forming an insulated connection 24. In the illustrated embodiment of the invention, shown in interrupted form for simplicity, there are twenty-six load coils 18, fifty-two pairs of paired conductors 22 in telephone cable 12, so that there are one hundred four insulated connections 24. Then, the individual bifilar-wound torodial core load coils 18 are inserted in enclosures 26 and 28. As can be seen, enclosure 26 is flat, for holding load coils 18 in a side-by-side relationship, and having the cross-sectional outline of a rectangle. Enclosure 26 has an open edge 30, and is made of a resilient plastic material, so that enclosure 26 may be spread apart at open edge 30 for insertion of load coils 18, and so that winding ends 23 of load coils 18 may pass through open edge 30 for connection to paired conductors 22. Preferably, enclosure 26 is provided with a number of inward protrusions 31 in surface 32, adapted to be received in the central aperatures of the torodial cores of load coils 18, to retain each load coil 18 in predetermined position. Enclosure 28 is of a generally tubular shape for maintaining a plurality of load coils 18 in a stacked relationship, formed of two arcuate sections 33, leaving open seams 34 between arcuate sections 33. Each arcuate section 33 is provided with a series of radially inward projections 36 at spaced intervals, for maintaining load coils 18 in a spaced-apart stacked relationship. Each arcuate section 32 also has end wall sections 38 for retaining a load coil 18 at either end of enclosure 28.

After coils 28 are installed in enclosures 26 and 28, arcuate sections 33 of enclosure 28 are preferably bound together, and the paired conductors 22 connected to winding ends 23 of coils 18 in enclosure 28 are dressed alongside of enclosure 28, and maintained in position such as by wraps of conventional tape such as masking tape 40 and 42 at appropriate points along the length of enclosure 28. The enclosure 26, containing additional coils 18, is placed along side enclosure 28, and enclosure 26 and 28 are bound together, such as by wraps of conventional masking tape 46 and 48, at appropriate points along the length of enclosures 26 and 28. As will be apparent, this assembly sequence can be varied as convenient. However, the method of assembly described provides a neat and compact sub-assembly, using a minimum of components, and inexpensive conventional materials, as well as resulting in a mechanically strong sub-assembly. Then, a layer of hot-melt glue 52 is applied adjacent end 20 of cable 12. In an actual physical embodiment in accordance with the first embodiment of the invention, hot-melt glue layer 52 is applied for a distance of four inches from end 20 of cable 12. A wrapping of thin sheet foam material 54, such as polyethylene sheet foam, is wrapped around the assembly of coils 18 and enclosures 26 and 28 and maintained in position by wraps of masking tape 56. As will be again apparent, this sequence of operations in assembling a load coil assembly according to the invention is not critical to the invention.

Then, the assembly of coils 18 in enclosures 26 and 28 wrapped with sheet foam 54 is inserted into a case 58. Case 58 is a closed-end tube of heat shrinkable material, such as electron beam irradiated cross-linked polyethylene. Case 58 may then be filled with an encapsulating compound 60 up to line 62. As will be apparent, load coil package 10 would be rotated from the position shown in FIG. 1 for this operation. Encapsulating compound 60 is preferably used, to give load coil package 10 additional mechanical strength, and to protect load coils 18 from environmental damage. However, as will be apparent, it could be omitted if desired.

It should be specifically noted that a conventional air block is not applied to the end 20 of pressurizable telephone cable 12. A conventional air block is formed by placing a mold over the cable end and around the protruding paired conductors, and then pouring a compound adapted to flow between the paired conductors into the mold. When hardened, this prevents pressurized air from escaping from the cable end. Therefore, when encapsulating compound 60 is added, it will fill substantially all of the voids within case 58, but will not flow between all of paired conductors 22, so that gas under pressure supplied to pressurizable telephone cable 12 will pressurize the interior of case 58, preventing entrance of contaminating material such as water, should case 58 be accidentally punctured or develop a leak, Then, end portion 64 of case 58 is heated, to cause it to shrink down about telephone cable 12 adjacent end 20 and layer 52 of hot-melt glue. Heating end portion 64 will also soften the layer of hot-melt glue 52, forming a gas-tight seal. As will be apparent, a sufficient seal may be formed without the addition of layer 52 of hot-melt glue, layer 52 being added to insure a repeatable and dependable connection between case 58 and telephone cable 12. Heat shrinkable pressurization cap 14 is then applied to the opposite end of cable 12 from load coil package 10, and pressure is applied to cable 12 through pressure valve 16. This is done to test the assembly and insure the integrity of case 58 and the junction between end portion 64 of case 58 and telephone cable 12. Pressure is retained in telephone cable 12 by pressure valve 16 of cap 14.

For installation into a telephone system, cap 14 is removed, and the insulation and outer covering of multiple conductor pressurizable telephone cable 12 is removed from end 66 of cable 12, exposing paired conductors 22, which are then connected into the telephone lines as appropriate. After the connection of paired conductors 22, a conventional splice box is applied around the connections, the splice box being typically a two-section tubular case of relatively large diameter, with seals at either end and between sections of relatively large diameter, applied around the connection between cable 12 and telephone system, so that pressure applied to cables in the telephone system will be applied to multiple conductor pressurizable telephone cable 12 and load coil package 10.

Figure 4:
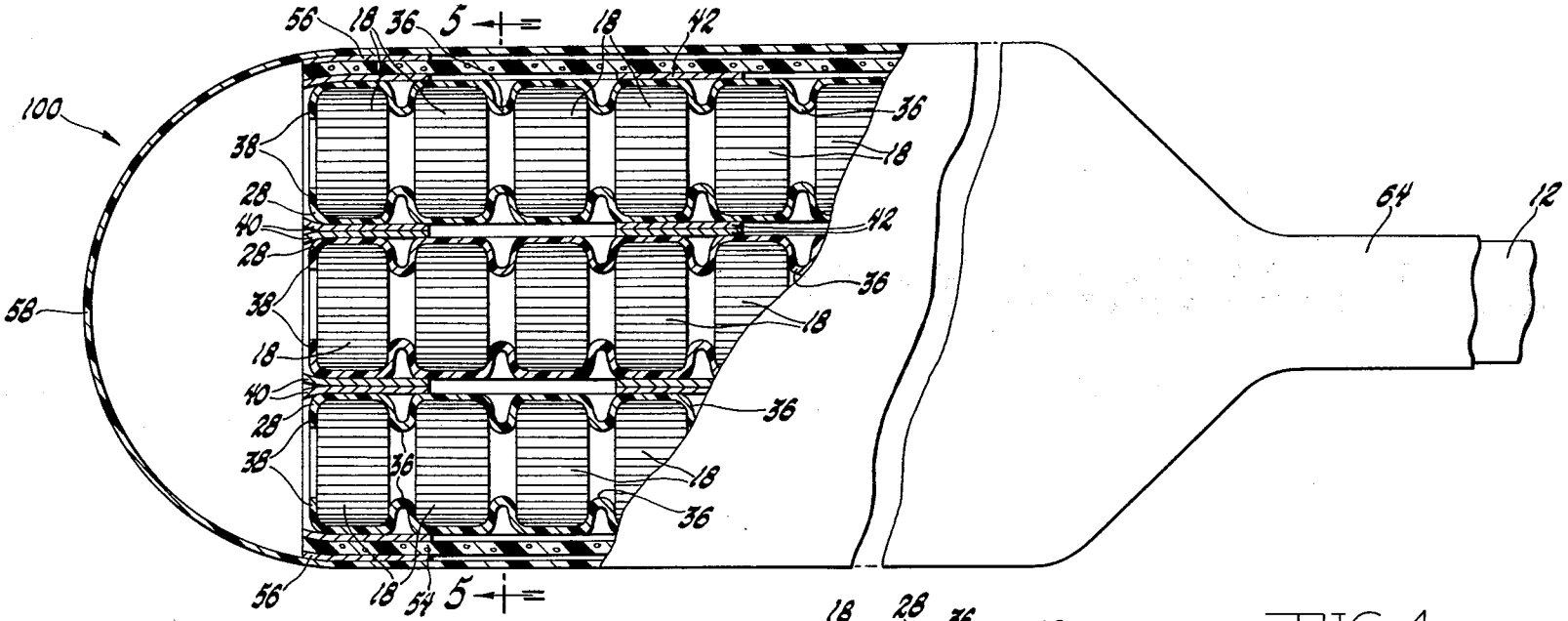
FIG. 4 is a side elevational view, partially in section, of a load coil assembly according to a second embodiment of the invention.
Figure 5:
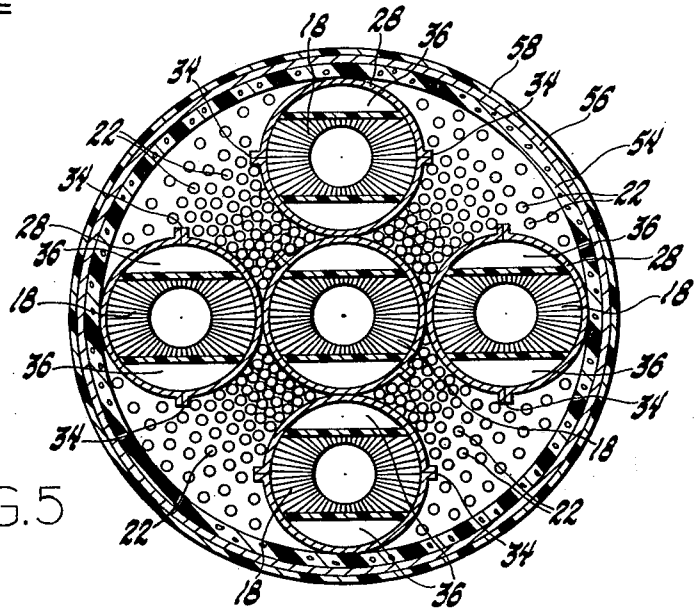
FIG. 5 is a sectional view taken along line 5—5 in FIG. 4.

FIGS. 4 and 5 relate to larger assemblies of load coils 18. It is contemplated that as many as two thousand, or more load coils 18 will be inserted in a case 58 of appropriate length and diameter, connected to a cable 12 having an appropriate number of paired conductors 22. As will be apparent, on sizes of this magnitude, binding means shown as masking tape 40, 42, 46 and 56 may be replaced or supplemented by more substantial binding means, such as by fiber reinforced filament tape or by serrated locking molded nylon wire ties or the like.

FIG. 4 illustrates the cross-section of a load coil package 100 adapted to contain fifty or more loading coils 18, in contrast to the twenty-six coils 18 shown in FIGS. 1 to 3. The major difference between the embodiment shown in FIGS. 4 and 5, and the embodiments shown in FIGS. 1 to 3 is that all load coils 18 are encased in tubular enclosures 28, no flat enclosures 26 being used. FIG. 4 is typical of all embodiments of the invention involving more than twenty-six load coils 18, all embodiments having a greater number of load coils 18 having a greater number of tubular enclosures 28, tubular enclosures 28 themselves being lengthened to accommodate fifty or more load coils 18. Load coil assemblies according to the invention of up to two thousand five hundred load coils are presently contemplated.

The assembly sequence for the embodiments shown in FIGS. 4 and 5 is similar to the assembly sequence for the embodiment shown in FIGS. 1, 2, and 3. After the winding end 23 of individual bifilar-wound toroidal core load coils 18 are connected to paired conductors 22 and dipped into an insulating compound to form insulated connections 24, they are placed between the two sections of a tubular enclosure 28, and their winding ends passed through open seams 34.

As best shown in FIG. 1, each assembly of load coils 18 in enclosure 28 is bound at intervals with binding means such as masking tape 40*a* and 42*a* along the length of enclosure 28. Binding means such as masking tape 40*a*, 42*a* may also be used to dress and position paired connectors 22 along side enclosures 28, if desired. The individual enclosures 28 are then positioned adjacent each other, and, if desired, bound in a bundle with binding means such as masking tape; not shown. Then, a wrapping of thin sheet foam material such as polyethylene sheet foam 54 is wrapped around the assembled enclosures 28, and held in place with wraps of masking tape 56 or the like. This assembly is then inserted into a larger case 58. As before, case 58, a closed-end tube of heat shrinkable material such as electron beam radiated cross-linked polyethylene may be filled with an encapsulated compound and end 64 may be heat shrunk over an area of hot-melt glue 52 on the end of cable 12.

As will be apparent from FIGS. 1–3 and 4–5, the most space efficient grouping of telephone load coils for small numbers of such load coils utilizes a flat enclosure 26 and a tubular enclosure 28, and the most space efficient grouping of load coils 18 for large numbers of such load coils utilizes tubular enclosures 28 of the desired number and length grouped in a generally circular configuration.

It will be obvious to one skilled in the art to make numerous modifications and variations to the instant invention such as in the configuration of load coils or their enclosures or supports, or in the method of insulating the connection between winding ends and tip and ring wires. Such variations and modifications may be made without departing from the spirit and scope of the invention.

What is claimed is:

1. A method of making a pressurizable load coil assembly, comprising the steps of:

providing a section of pressurizable telephone cable having a plurality of conductors;

providing a flat enclosure package for holding a first plurality of said load coils in a side-by-side relationship and defining a first opening therein for passage of wire leads of said first plurality of load coils therethrough;

providing at least one generally tube-shaped enclosures for holding a second plurality of said load coils in a stacked relationship and defining at least one second opening therein for passage of wire leads of said second plurality of wire leads of said load coils therethrough;

connecting said plurality of conductors of said pressurizable telephone cable to said wire leads of said first plurality of load coils and of said second plurality of load coils in a predetermined arrangement to form a plurality of insulated connections therebetween, placing said first plurality of load coils in said flat enclosure with said wire leads passing through said first opening;

placing said second plurality of load coils in said generally tube-shaped enclosure with said wire leads passing through said second opening;

binding said flat enclosure to at least one said generally tube-shaped enclosure in a parallel relationship to form a load coil package;

providing a heat shrinkable tube having a first closed end and a second open end;

inserting said load coil package in said heat shrinkable tube adjacent said first closed end; and heating said second open end of said heat shrinkable tube to shrink said second end about said pressurizable telephone cable.

2. A method of making a pressurizable load coil assembly, comprising the steps of:

providing a section of pressurizable telephone cable having a plurality of conductors;

providing at least two generally tube-shaped enclosures, each for holding a plurality of said load coils in a stacked relationship and each defining at least one opening therethrough for passage of wire leads of said load coils therethrough;

connecting said plurality of conductors of said pressurizable telephone cable to said wire leads of each said plurality of load coils in a predetermined arrangement to form a plurality of insulated connections therebetween;

placing each said plurality of load coils into each said generally tube-shaped enclosure in a stacked relationship, with said wire leads passing through said opening;

binding said generally tube-shaped enclosures together in a parallel relationship to form a load coil package;

providing a heat shrinkable tube having a first closed end and a second open end;

inserting said load coil package into said tube adjacent said first closed end; and heating said second open end of said heat shrinkable tube to shrink said second end about said pressurizable telephone cable.

3. A method of making a pressurizable load coil assembly according to claim 1 or 2 including the step of pouring encapsulating material into said tube before heating and shrinking said second open end.

4. A method of making a pressurizable load coil assembly according to claim 1 or 2, including the step of:

coating said pressurizable telephone cable with a layer of hot melt adhesive adjacent an interior surface of said second open end of said heat shrinkable tube before heating and shrinking said second open end.

5. A method of making a pressurizable load coil assembly according to claim 1 or 2, including the step of:

insulating said insulated connections by dipping said connections into an insulating compound.

6. A pressurizable telephone load coil assembly, comprising:

a section of pressurizable telephone cable having a plurality of conductors;

said conductors being electrically connected to a plurality of toroidal telephone load coils;

a first portion of said plurality of toroidal telephone load coils being disposed in a flat enclosure holding said first portion of said plurality of load coils in a side-by-side relationship and defining an opening therethrough for passage of wire leads of said load coils therethrough, said wire leads passing therethrough;

a second portion of said plurality of toroidal telephone load coils being disposed in a generally tube-shaped enclosure for holding said second portion of said plurality of said load coils in a stacked relationship and defining at least one opening therethrough for passage of wire leads of said load coils therethrough, said wire leads passing therethrough;

binding means disposed around said flat enclosure and said generally tube-shaped enclosure for holding said enclosures in a parallel relationship to form a load coil package;

a heat shrinkable tube having a first closed end and second open end disposed around said load coil package;

said second open end being shrunk by heating to conform to said section of pressurizable telephone cable and to form an airtight seal thereto.

7. A pressurizable load coil assembly according to claim 6 wherein;

said flat enclosure is provided with a plurality of inwardly directed projections from a surface thereof, a central opening of one said load coil being disposed about one said projection to retain said load coil in a predetermined position.

8. A pressurizable telephone load coil assembly, comprising:

a section of pressurizable telephone cable having a plurality of conductors;

said conductors being electrically connected to a plurality of toroidal telephone load coils;

said plurality of toroidal telephone load coils being separated into at least two groups of toroidal telephone coils;

each said group being diaposed in a generally tube-shaped enclosure for holding said load coils in a stacked relationship and defining at least one opening therethrough for passage of wire leads of said load coils therethrough, said wire leads passing therethrough;

binding means disposed around said generally tube-shaped enclosures for retaining said enclosures in a paralled relationshp to form a load coil package;

a heat shrinkable tube having a first closed end and a second open end disposed around said load coil package;

said second open end being shrunk by heating to conform to said section of pressurizable telephone cable and to form an airtight seal thereto.

9. A pressurizable load coil assembly according to claim 6 or 8, including;

encapsulating material disposed about said load coil package within said tube.

10. A pressurizable load coil assembly according to claim 6 or 8, including;

heat responsive sealing means disposed between said open end of said case and an adjacent portion of said section of pressurizable telephone cable.

11. A pressurizable load coil assembly according to claim 10, wherein;

said heat responsive sealing means is a layer of hot melt glue applied to an end of said section of pressurizable telephone cable adjacent said open end of said tube.

12. A pressurizable load coil assembly according to claim 6 or 8, wherein;

said generally tube-shaped enclosure includes a first extended arcuate section including a plurality of said load coils in a spaced stacked relationship, and including end wall sections for retaining end ones of said load coils in said stacked relationship.

13. A pressurizable load coil assembly according to claim 6 or 8 wherein;

said electrical connections between said plurality of conductors of said cable and said plurality of load coils are insulated connections including an insulating material;

said insulating material being an air-curing resin.

* * * * *